US009422133B2

(12) United States Patent
Rebillard et al.

(10) Patent No.: US 9,422,133 B2
(45) Date of Patent: Aug. 23, 2016

(54) ELEVATOR CAR CONTROL IN A LANDING ZONE USING A MACHINE BRAKE IN RESPONSE TO UNDESIRED CAR MOVEMENT

(75) Inventors: Pascal Rebillard, Glen (FR); Nicolas Fonteneau, Vitry aux Loges (FR); Gerard Sirigu, Glen (FR); Gregor Stricker, Berlin (DE); James L. Hubbard, Kensington, CT (US); Peter Herkel, Berlin (DE); Robert Bryan Leach, Canton, CT (US); Guillaume Bonatre, Ousson/Loire (FR); Fabrice Boniface, Chatillon sur Loire (FR); Stephane Gourjeande, Gien (FR)

(73) Assignee: Otis Elevator Company, Farmington, CT (US)

( * ) Notice: Subject to any disclaimer, the term of this patent is extended or adjusted under 35 U.S.C. 154(b) by 523 days.

(21) Appl. No.: 14/000,238

(22) PCT Filed: Feb. 28, 2011

(86) PCT No.: PCT/US2011/026408

§ 371 (c)(1),
(2), (4) Date: Aug. 19, 2013

(87) PCT Pub. No.: WO2012/118473

PCT Pub. Date: Sep. 7, 2012

(65) Prior Publication Data

US 2013/0327598 A1 Dec. 12, 2013

(51) Int. Cl.
*B66B 1/42* (2006.01)
*B66B 1/32* (2006.01)
(Continued)

(52) U.S. Cl.
CPC ... *B66B 1/32* (2013.01); *B66B 1/40* (2013.01); *B66B 1/44* (2013.01)

(58) Field of Classification Search
CPC ..... B66B 1/32; B66B 1/40; B66B 1/44
USPC ..... 187/281, 283, 284, 287, 288, 391, 302, 187/393, 280
See application file for complete search history.

(56) References Cited

U.S. PATENT DOCUMENTS 4,042,068 A * 8/1977 Ostrander ..... B66B 1/28 187/292
4,116,306 A * 9/1978 Alley ..... B66B 1/308 187/288

(Continued)

FOREIGN PATENT DOCUMENTS

CN 101468769 A 7/2009
CN 101531312 A 9/2009

(Continued)

OTHER PUBLICATIONS

International Preliminary Report on Patentability for International application No. PCT/US2011/026408 dated Sep. 12, 2013.

(Continued)

*Primary Examiner* — Anthony Salata
(74) *Attorney, Agent, or Firm* — Carlson, Gaskey & Olds

(57) ABSTRACT

An exemplary method is useful for controlling movement of an elevator car in an elevator system that includes a machine that selectively moves the elevator car and a machine brake that selectively resists movement of the elevator car. The method includes determining whether the elevator car is near a landing and determining whether a door of the elevator car is open. A desired operation includes desired movement of the elevator car while the elevator car is near the landing and the door is open. A determination is made whether the elevator car moves other than according to the desired movement. The machine brake is applied for stopping movement of the elevator car responsive to elevator car movement other than the desired movement while the elevator car is near the landing and the door is open.

13 Claims, 2 Drawing Sheets

(51) Int. Cl.
*B66B 1/44* (2006.01)
*B66B 1/40* (2006.01)

(56) References Cited

U.S. PATENT DOCUMENTS

| | | | | |
|---|---|---|---|---|
| 4,245,721 | A * | 1/1981 | Masel | G01D 5/34 187/291 |
| 4,337,846 | A * | 7/1982 | Yonemoto | B66B 1/44 187/284 |
| 4,674,604 | A * | 6/1987 | Williams | B66B 1/50 187/291 |
| 4,785,914 | A * | 11/1988 | Blain | B66B 1/24 187/280 |
| 4,923,055 | A * | 5/1990 | Holland | B66B 5/04 187/287 |
| 5,159,162 | A * | 10/1992 | Tatino | B66B 1/44 187/280 |
| 7,073,632 | B2 | 7/2006 | Martin | |
| 7,137,484 | B2 | 11/2006 | Martin | |
| 7,775,329 | B2 | 8/2010 | Eckenstein et al. | |
| 7,775,330 | B2 * | 8/2010 | Kattainen | B66B 5/04 187/287 |
| 7,849,975 | B2 | 12/2010 | Ketonen et al. | |
| 7,921,969 | B2 * | 4/2011 | Stolt | B66B 1/30 187/293 |
| 8,118,140 | B2 * | 2/2012 | Kattainen | B66B 1/34 187/284 |
| 8,136,635 | B2 | 3/2012 | Christy et al. | |
| 8,365,873 | B2 * | 2/2013 | Viita-Aho | B66B 5/02 187/314 |
| 8,408,364 | B2 * | 4/2013 | Kangas | B66B 1/3492 187/247 |
| 8,869,945 | B2 * | 10/2014 | Harkonen | B66B 1/28 187/288 |
| 2004/0238288 | A1 | 12/2004 | Martin | |
| 2004/0238289 | A1 | 12/2004 | Martin | |

FOREIGN PATENT DOCUMENTS

| | | | |
|---|---|---|---|
| CN | 101670967 | A | 3/2010 |
| EP | 0807084 | B1 | 8/2004 |
| EP | 1714933 | A1 | 10/2006 |
| EP | 1752407 | A1 | 2/2007 |
| JP | 61-189065 | | 11/1986 |
| JP | 1247388 | | 10/1989 |
| JP | H01247388 | | 10/1989 |
| JP | 6080329 | A | 3/1994 |
| JP | 2007055691 | A | 3/2007 |
| JP | 2010208731 | | 9/2010 |
| KR | 20000014643 | | 3/2000 |
| KR | 20010029320 | A | 4/2001 |
| KR | 10-0295879 | | 5/2002 |
| KR | 20090014667 | A | 2/2009 |

OTHER PUBLICATIONS

International Search Report and Written Opinion of the International Searching Authority for International application No. PCT/US2011/026408 dated Nov. 25, 2011.

Supplemental Search Report for Chinese Patent Application No. 201180068618.6 dated Jan. 28, 2015.

State Intellectual Property Office of People's Republic China, Search Report for Application No. 201180068618.6 dated Jun. 5, 2014.

* cited by examiner

ELEVATOR CAR CONTROL IN A LANDING ZONE USING A MACHINE BRAKE IN RESPONSE TO UNDESIRED CAR MOVEMENT

BACKGROUND

Elevator systems have several features that are intended to ensure efficient, reliable and comfortable service to passengers. For example, passengers want easy access to an elevator car. Control over the position of an elevator car parked at a landing makes it easier for passengers to board or exit the elevator car.

There are industry standards and codes that establish parameters that must be met when parking an elevator car at a landing. A recent revision to the EN81-1:1998 standard in Europe requires limiting movement of an elevator car at a landing when the car doors are open. U.S. Pat. Nos. 7,073,632; 7,137,484 and 7,775,329 each describe a proposal to limit movement of an elevator car under such conditions. It is not clear that such approaches will satisfy the recent standard revision or if such devices will provide an economical solution.

SUMMARY

An exemplary method is useful for controlling movement of an elevator car in an elevator system that includes a machine that selectively moves the elevator car and a machine brake that selectively resists movement of the elevator car. The method comprises determining whether the elevator car is near a landing and determining whether a door of the elevator car is open. A desired operation includes desired movement of the elevator car while the elevator car is near the landing and the door is open. A determination is made whether the elevator car moves other than according to the desired movement. The machine brake is applied for stopping movement of the elevator car responsive to elevator car movement other than the desired movement while the elevator car is near the landing and the door is open.

In an embodiment of the exemplary method of the preceding paragraph, determining whether the elevator car moves other than according to the desired movement may be based on an indication of a position of the elevator car relative to the landing.

Another embodiment of the exemplary method of either of the two previous paragraphs may include using a door zone detector for determining whether the elevator car is near the landing and for determining whether the elevator car moves other than according to the desired movement.

Another embodiment of the exemplary method of any of the three preceding paragraphs may include using a level position detector for determining whether the elevator car moves other than according to the desired movement.

In another embodiment of the exemplary method of any of the preceding paragraphs, the desired operation may comprise releveling the elevator car after the elevator car has stopped at the landing.

In another embodiment of the exemplary method of any of the preceding paragraphs, the desired operation may comprise approaching the landing and opening the door before the elevator car stops at the landing.

In another embodiment of the exemplary method of any of the preceding paragraphs, the desired operation may comprise departing from the landing before the door has closed.

An exemplary elevator system includes a hoistway having a plurality of landings. An elevator car is moveable within the hoistway to provide elevator service to any of the landings. The elevator car includes at least one door that is selectively opened or closed. A machine selectively causes movement of the elevator car. A machine brake selectively resists movement of the elevator car. A controller determines whether the elevator car is near a landing, whether a door of the elevator car is open and whether the elevator car moves other than according to a desired movement associated with a desired operation while the elevator car is near the landing and the door is open. The machine brake stops movement of the elevator car responsive to elevator car movement other than the desired movement while the elevator car is near the landing and the door is open.

In an embodiment of the exemplary system of the preceding paragraph, the controller may determine whether the elevator car moves other than according to a desired movement associated with a desired operation while the elevator car is near the landing and the door is open based on an indication of a position of the elevator car relative to the landing.

In another embodiment of the exemplary system of either of the two preceding paragraphs, the system may include a door zone detector near each landing. Each door zone detector may be configured to provide an indication of a position of the elevator car near the corresponding landing. The controller may use the indication from the door zone detector for determining whether the elevator car is near the landing and for determining whether the elevator car moves other than according to the desired movement.

In another embodiment of the exemplary system according to any of the three preceding paragraphs, the system may include a level position detector near each landing. Each level position detector may be configured to provide an indication of a vertical position of the elevator near the corresponding landing. The controller may use the indication for determining whether the elevator car moves other than according to the desired movement.

In another embodiment of the exemplary system of any of the preceding paragraphs, the desired operation may comprise releveling the elevator car after the elevator car has stopped at the landing.

In another embodiment of the exemplary system of any of the preceding paragraphs, the desired operation may comprise approaching the landing and opening the door before the elevator car stops at the landing.

In another embodiment of the exemplary system of any of the preceding paragraphs, the desired operation may comprise departing from the landing before the door has closed.

In another embodiment of the exemplary system of any of the preceding paragraphs, the controller is configured to prevent further movement of the elevator car subsequent to the machine brake stopping movement of the elevator car responsive to elevator car movement other than the desired movement while the elevator car is near the landing and the door is open until the controller is manually reset.

The various features and advantages of a disclosed example embodiment will become apparent to those skilled in the art from the following detailed description. The drawings that accompany the detailed description can be briefly described as follows.

DETAILED DESCRIPTION

Figure 1:
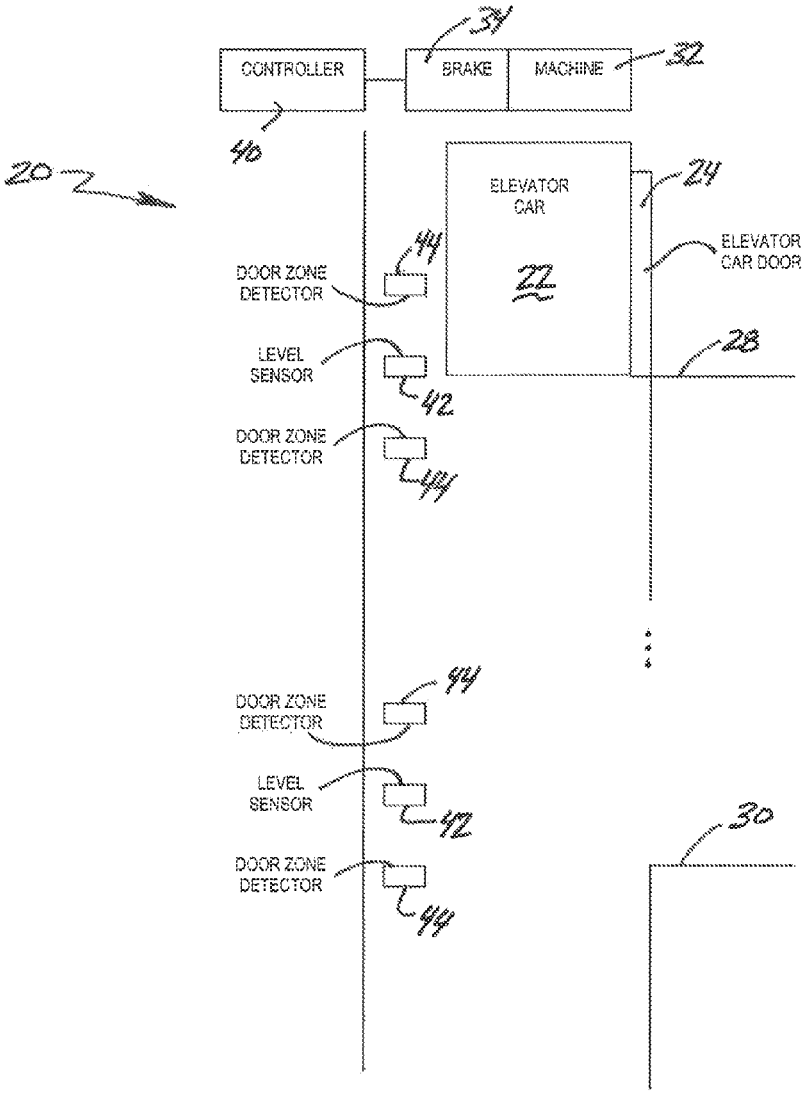
FIG. 1 schematically illustrates selected portions of an example elevator system designed according to an embodiment of this invention.

FIG. 1 schematically shows selected portions of an elevator system 20. Only selected portions are illustrated. Those skilled in the art will realize that many other components are included in an elevator system. Such components are omitted from the illustration and this discussion for the sake of brevity and because those skilled in the art are already aware of such components.

An elevator car 22 includes at least one door 24. The elevator car 22 is moveable within a hoistway 26 to provide elevator service to a plurality of landings 28 and 30, for example. The elevator car 22 is illustrated parked at the landing 28.

In the illustrated example, a machine 32 selectively causes movement of the elevator car 22. A brake 34, which is associated with the machine, selectively resists movement of the elevator car by applying a braking force for purposes of stopping the elevator car 22 at one of the landings 28 or 30, for example. In some examples, the brake 34 is also used for overspeed protection in an upward direction of car movement. A controller 40 controls the operation of the machine 32 and the machine brake 34, respectively.

The disclosed example includes control features to control movement of the elevator car 22 when it is parked at a landing such as the landing 28. Even though elevator cars remain essentially stationary when parked at a landing there are times when some movement is desired when the doors are not closed. For example, some movement is desired to relevel a car in response to a change in the load on the car that alters the relative position of the elevator car floor and the adjacent landing floor. Some elevator systems include features that are intended to reduce wait times for passengers such as allowing the doors to begin opening before the car has stopped at a landing or allowing the car to begin leaving a landing before the doors are fully closed, for example. Under such circumstances, the elevator car 22 is moving when the door 24 is open and the car 22 is near a landing.

The illustrated example provides the ability to relevel the elevator car 22 when it is parked at one of the landings 28 or 30. A level sensor 42 is provided to inform the controller 40 when the elevator car 22 is at a desired level at a landing. If there is a significant change in the load on the car 22, the car may move slightly out of the desired, leveled position. The level sensor 42 indicates this condition to the controller 40, which responsively initiates a releveling operation. When releveling the elevator car 22, there is a desired movement of the elevator car from the current position to the desired, leveled position at the corresponding landing. During a releveling operation, the brake 34 is released to allow for the desired movement of the elevator car 22. The machine 32 typically causes the desired movement of the elevator car 22. During a desired releveling operation, the elevator door 24 will be open and the elevator car 22 is near the landing 28, for example.

Whenever the elevator car 22 is near a landing and the door is opened, the controller 40 ensures that any movement of the elevator car is consistent with a desired movement of the car under those conditions. A known door bypass circuit (not illustrated) allows car movement when a door is open.

The illustrated example provides the ability to begin opening the elevator car door 24 before the car has completely stopped at a landing. The illustrated example also includes the ability to begin departing from a landing before the elevator car door 24 is fully closed. Door zone detectors 44 provide an indication of when the elevator car 22 approaches within an appropriate distance from a landing to allow the car doors to begin opening. The door zone detectors 44 provide information regarding a position of the elevator car 22 relative to the corresponding landing. The controller 40 uses information from the door zone detectors 44 to perform desired elevator car operations for a given circumstance such as approaching a landing or departing from the landing and controlling a door operator (not illustrated) for opening or closing the elevator car door 24.

The illustrated door zone detectors and level sensors may be realized using known sensing equipment and techniques for such purposes. The particular type of sensor or detector for a given elevator system may vary and those skilled in the art will realize how to select from among known components and techniques to meet their particular needs.

The controller 40 in this example maintains control over movement of the elevator car 22 including preventing uncontrolled movement of the elevator car 22 when it is near a landing and the car door 24 is open. For purposes of discussion, the car door 24 is considered open whenever it is not fully closed.

Figure 2:
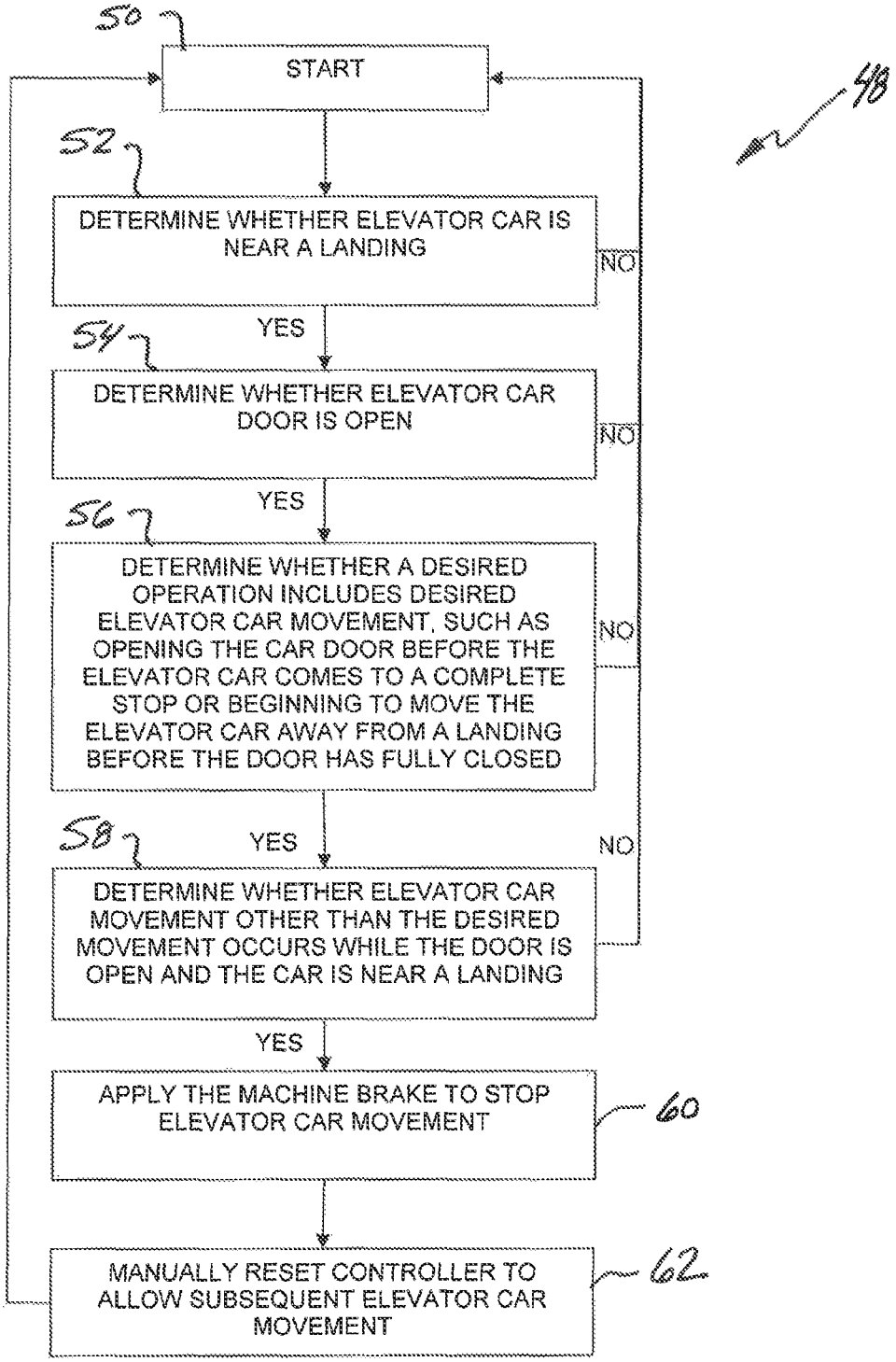
FIG. 2 is a flow chart diagram summarizing an example control strategy useful in an embodiment of this invention.

FIG. 2 includes a flowchart diagram 48 summarizing an example control approach; with flow diagram 50 starts at step 50. From the start step 50, the control protocol proceeds to step 52 at which the controller 40 determines whether the elevator car 22 is near a landing 28 or 30, for example. If the determination in step 52 is "no", the control protocol returns to start step 50. If, however, the determination in step 52 is "yes", the control protocol continues to step 54.

At step 54, the controller 40 determines whether the elevator car door 24 is open. If the determination in step 54 is "no", the control protocol returns to start step 50. If, however, the determination in step 54 is "yes", the control protocol continues to step 56.

At step 56 a determination is made whether a desired operation includes desired elevator car movement. Example desired operations include releveling the elevator car 22, opening the car door 24 before the elevator car 22 comes to a complete stop at a landing, or beginning to move the elevator car 22 away from a landing before the door 24 has fully closed. During any of the three example desired operations, the brake 34 is released to allow the desired elevator car movement. If the determination in step 56 is "no", the control protocol returns to start step 50. If, however, the determination in step 56 is "yes", the control protocol continues to step 58.

At step 58, the controller 40 determines whether the elevator car 22 is moving in a manner other than the desired movement associated with the desired operation. If such undesired movement occurs, such movement can be considered uncontrolled car movement. Accordingly, at step 58, the controller 40 determines whether there is any such uncontrolled movement while the door 24 is open and the car 22 is near a landing. If the determination in step 58 is "no", the control protocol returns to start step 50. If, however, the determination in step 58 is "yes", the control protocol continues to step 60.

At step 60, the controller 40 applies the machine brake 34 to stop any further movement of the elevator car 22. In one example, when the machine brake 34 is applied under such circumstances, the controller 40 requires a manual resetting operation to be performed before the controller 40 will put the elevator car 22 back into normal service mode.

In one example, the controller 40 uses information from the doors zone detectors 44 to determine whether the elevator car 22 moves in a manner that is inconsistent with a desired movement when the car door 24 is open and the car 22 is near a landing. The doors zone detectors are used in this example to indicate when there is such motion of the elevator car 22 by providing an indication of the position of the elevator car 22 relative to the corresponding landing. In some cases, if a floor of the elevator car 22 moves more than a threshold distance from the level of the corresponding landing floor, the controller 40 is programmed or configured to apply the brake 34.

One feature of using the door zone detectors 44 in this manner is that the illustrated example takes advantage of components already existing within the elevator system 20 and provides the additional ability of controlling movement of the elevator car 22 near a landing when the car door 24 is open by applying the machine brake 34 responsive to movement that is inconsistent with a desired movement of the elevator car 22.

In another example, the controller 40 uses an indication from a level sensor 42 regarding a position of the elevator car 22 relative to a corresponding landing for determining whether any movement of the elevator car 22 near a landing when the door 24 is open is inconsistent with a desired movement. In one example, an existing door bypass circuit (not illustrated) operates responsive to the level sensor signals for realizing the control over the machine brake.

In another example, a combination of information from a door zone detector 44 and a level sensor 42 is used for monitoring any movement of the elevator car 22 near a landing with the car door 24 open. In either case, position information is used by the controller 40 to determine when the elevator car 22 has moved in a manner that requires applying the machine brake 34 to stop such movement.

Information regarding the position of the elevator car 22 relative to a landing is used as the indication that the machine brake 34 should be applied in one example. In another example, the position information is used to determine a speed of movement. Still another example includes a combination of speed and position information. Such information allows the controller 40 to determine when to apply the brake 34, if the position or movement of the elevator car 22 is inconsistent with desired movement.

The illustrated example takes advantage of existing elevator system components and provides the ability to satisfy the requirements for preventing uncontrolled movement of an elevator car near a landing when the door is open. In one example, the controller 40 is part of elevator drive equipment that is responsible for machine control during normal elevator system operation. The disclosed example provides an economical solution to the requirement of maintaining control over movement of an elevator car near a landing when a car door is open that does not require any material change to existing elevator system components yet it provides an entirely new capability within such an elevator system.

In the disclosed example, once the brake is applied and the elevator car is stopped responsive to movement inconsistent with desired movement as described above, the car is taken out of service until an authorized individual resets the controller 40 to resume normal operation. This is shown at 62 in FIG. 2. Additional software is added to the controller 40 in one example to include such a required manual reset feature. In other examples software, firmware, hardware or a combination of these is added to the controller 40 to provide this additional feature.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling movement of an elevator car in an elevator system that includes a machine for moving the elevator car and a machine brake for preventing movement of the elevator car, the method comprising the steps of:
- determining whether the elevator car is near a landing;
- determining whether a door of the elevator car is open;
- performing a desired operation that includes desired movement of the elevator car while the elevator car is near the landing and the door is open;
- determining whether the elevator car moves other than according to the desired movement; and
- stopping movement of the elevator car by applying the machine brake responsive to elevator car movement other than the desired movement while the elevator car is near the landing and the door is open,
- wherein the desired operation comprises departing from the landing before the door has closed.

2. The method of claim 1, wherein determining whether the elevator car moves other than according to the desired movement is based on an indication of a position of the elevator car relative to the landing.

3. The method of claim 2, comprising
- using a door zone detector for determining whether the elevator car is near the landing; and
- using the door zone detector for determining whether the elevator car moves other than according to the desired movement.

4. The method of claim 2, comprising using a level position detector for determining whether the elevator car moves other than according to the desired movement.

5. The method of claim 1, wherein the desired operation comprises releveling the elevator car after the elevator car has stopped at the landing.

6. The method of claim 1, wherein the desired operation comprises approaching the landing and opening the door before the elevator car stops at the landing.

7. An elevator system, comprising
- a hoistway including a plurality of landings;
- an elevator car that is moveable within the hoistway to provide elevator service to any of the landings, the elevator car including at least one door that is selectively opened or closed;
- a machine that selectively causes movement of the elevator car;
- a machine brake that selectively resists movement of the elevator car; and
- a controller that is configured to
  - determine whether the elevator car is near a landing,
  - determine whether a door of the elevator car is open,
  - determine whether the elevator car moves other than according to a desired movement associated with a desired operation while the elevator car is near the landing and the door is open, and
- wherein the machine brake stops movement of the elevator car responsive to elevator car movement other than the desired movement while the elevator car is near the landing and the door is open,
- wherein the desired operation comprises approaching the landing and opening the door before the elevator car stops at the landing,
- wherein the desired operation comprises departing from the landing before the door has closed.

8. The elevator system of claim 7, wherein the controller determines whether the elevator car moves other than according to a desired movement associated with a desired operation while the elevator car is near the landing and the door is open based on an indication of a position of the elevator car relative to the landing.

9. The elevator system of claim 8, comprising a door zone detector near each landing, each door zone detector configured to provide an indication of a position of the elevator car near the corresponding landing; and wherein the controller uses the indication from the door zone detector for determining whether the elevator car is near the landing and for determining whether the elevator car moves other than according to the desired movement.

10. The elevator system of claim 8, comprising a level position detector near each landing, each level position detector configured to provide an indication of a vertical position of the elevator near the corresponding landing; and wherein the controller uses the indication from the level position detector for determining whether the elevator car moves other than according to the desired movement.

11. The elevator system of claim 7, wherein the desired operation comprises releveling the elevator car after the elevator car has stopped at the landing.

12. The elevator system of claim 7, wherein the desired operation comprises approaching the landing and opening the door before the elevator car stops at the landing.

13. The elevator system of claim 7, wherein the controller is configured to prevent further movement of the elevator car subsequent to the machine brake stopping movement of the elevator car responsive to elevator car movement other than the desired movement while the elevator car is near the landing and the door is open until the controller is manually reset.

* * * * *